US006109244A

United States Patent [19]

Yamamoto et al.

[11] Patent Number: 6,109,244

[45] Date of Patent: Aug. 29, 2000

[54] FUEL INJECTION CONTROL APPARATUS FOR AN INTERNAL COMBUSTION ENGINE

[75] Inventors: Kenji Yamamoto, Anjo; Hirotada Yamada, Kariya, both of Japan

[73] Assignee: Denso Corporation, Kariya, Japan

[21] Appl. No.: 09/185,082

[22] Filed: Nov. 3, 1998

[30] Foreign Application Priority Data

Nov. 17, 1997 [JP] Japan ..... 9-314732
Sep. 8, 1998 [JP] Japan ..... 10-253167

[51] Int. Cl.[7] ..... F02M 51/00

[52] U.S. Cl. ..... 123/478; 123/494

[58] Field of Search ..... 123/491, 478, 123/494; 701/103, 104

[56] References Cited

U.S. PATENT DOCUMENTS 4,082,066 4/1978 Long ..... 123/490
5,865,158 2/1999 Cleveland et al. ..... 123/478
5,902,346 5/1999 Cullen et al. ..... 701/102

FOREIGN PATENT DOCUMENTS 56-81230 7/1981 Japan .
5-125984 5/1993 Japan .

*Primary Examiner*—Henry C. Yuen
*Assistant Examiner*—Arnold Castro
*Attorney, Agent, or Firm*—Nixon & Vanderhye p.c.

[57] ABSTRACT

A fuel injection control apparatus which infers fuel temperature from cooling water temperature and intake air temperature. From these inferred temperatures, a correction coefficient of the air-fuel ratio is found from the inferred fuel temperature and the intake manifold pressure by using data stored in a map. The map is set up so that a characteristic thereof shows that, the higher the inferred temperature of fuel, the larger the correction coefficient of the air-fuel ratio and, thus, the longer the fuel injection time. Subsequently, an ineffective injection time TV is corrected in accordance with the inferred fuel temperature. A fuel injection time TI is then computed from a basic injection time TP, a representative correction coefficient Ftotal representing all correction coefficients including the correction coefficient of the air-fuel ratio, and the ineffective injection time TV.

19 Claims, 10 Drawing Sheets

FIG. 5

AIR-FUEL RATIO CORRECTION COEFFICIENT MAP

| | FUEL TEMP. (°C) | -40 | -30 | -20 | ····· | 100 | 110 | 120 |
|---|---|---|---|---|---|---|---|---|
| INTAKE MANIFOLD PRESSURE | 0.125 | | | | ····· | | | |
| | 0.25 | | | | ····· | | | |
| | 0.375 | | | | ····· | | | |
| | 0.5 | | | | ····· | | | |
| | 0.625 | | | | ····· | | | |
| | 0.75 | | | | ····· | | | |
| | 0.875 | | | | ····· | | | |
| | (ATMOSPHERIC PRESSURE) 1 | | | | ····· | | | |

(※1) THE INTAKE MANIFOLD PRESSURE IS A RATIO TO THE ATMOSPHERIC PRESSURE, THE VALUE OF WHICH IS SET AS 1.

(※2) DATA FOR AIR-FUEL RATIO CORRECTION COEFFICIENTS ARE STORED IN THE BLANKS.

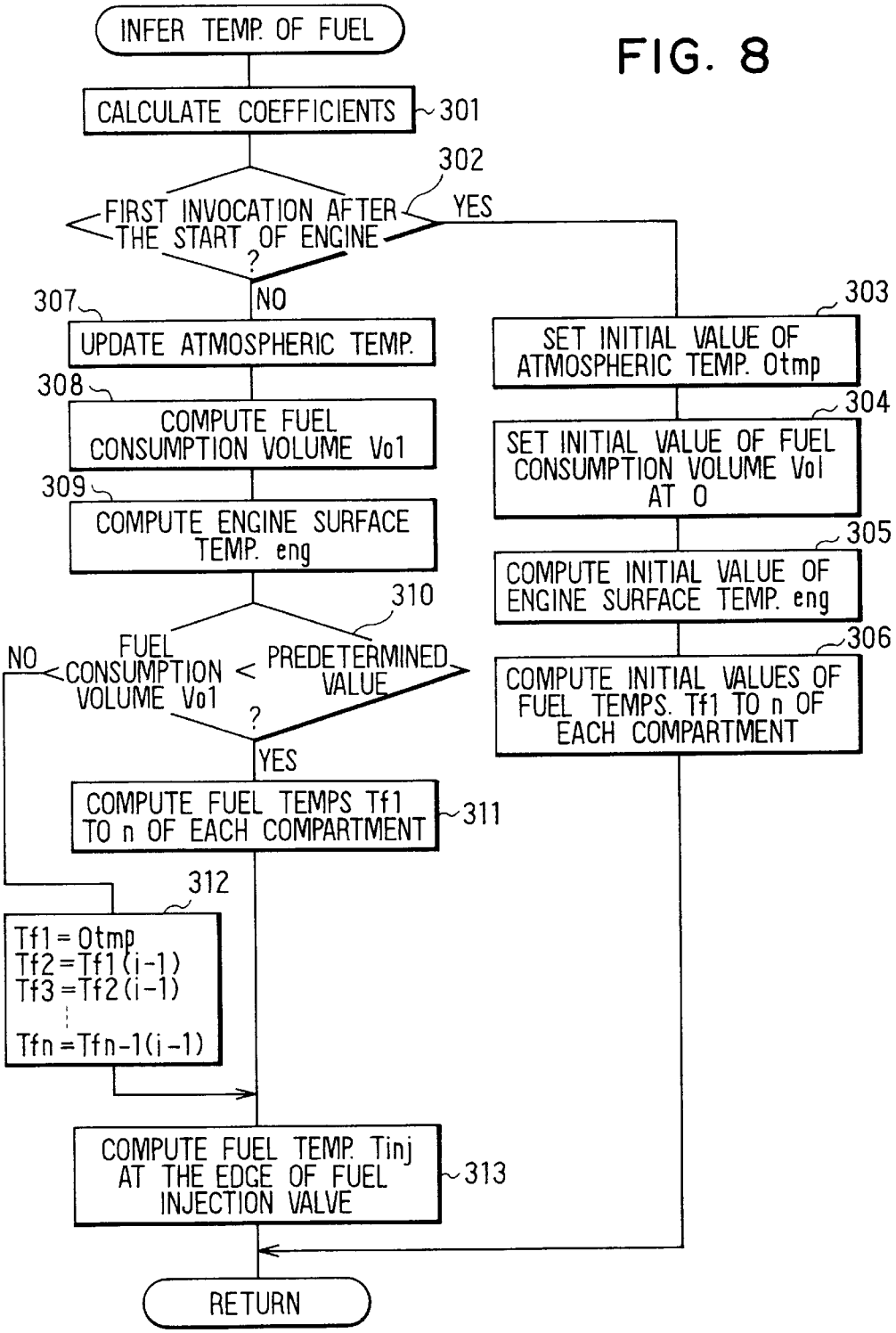
FIG. 8
INFER TEMP. OF FUEL
CALCULATE COEFFICIENTS
301
302
FIRST INVOCATION AFTER THE START OF ENGINE ?
YES
NO
303
SET INITIAL VALUE OF ATMOSPHERIC TEMP. Otmp
304
SET INITIAL VALUE OF FUEL CONSUMPTION VOLUME Vol AT 0
305
COMPUTE INITIAL VALUE OF ENGINE SURFACE TEMP. eng
306
COMPUTE INITIAL VALUES OF FUEL TEMPS. Tf1 TO n OF EACH COMPARTMENT
307
UPDATE ATMOSPHERIC TEMP.
308
COMPUTE FUEL CONSUMPTION VOLUME Vo1
309
COMPUTE ENGINE SURFACE TEMP. eng
310
FUEL CONSUMPTION VOLUME Vo1 < PREDETERMINED VALUE ?
NO
YES
COMPUTE FUEL TEMPS Tf1 TO n OF EACH COMPARTMENT
311
312
Tf1 = Otmp
Tf2 = Tf1(i-1)
Tf3 = Tf2(i-1)
Tfn = Tfn-1(i-1)
COMPUTE FUEL TEMP. Tinj AT THE EDGE OF FUEL INJECTION VALVE
313
RETURN

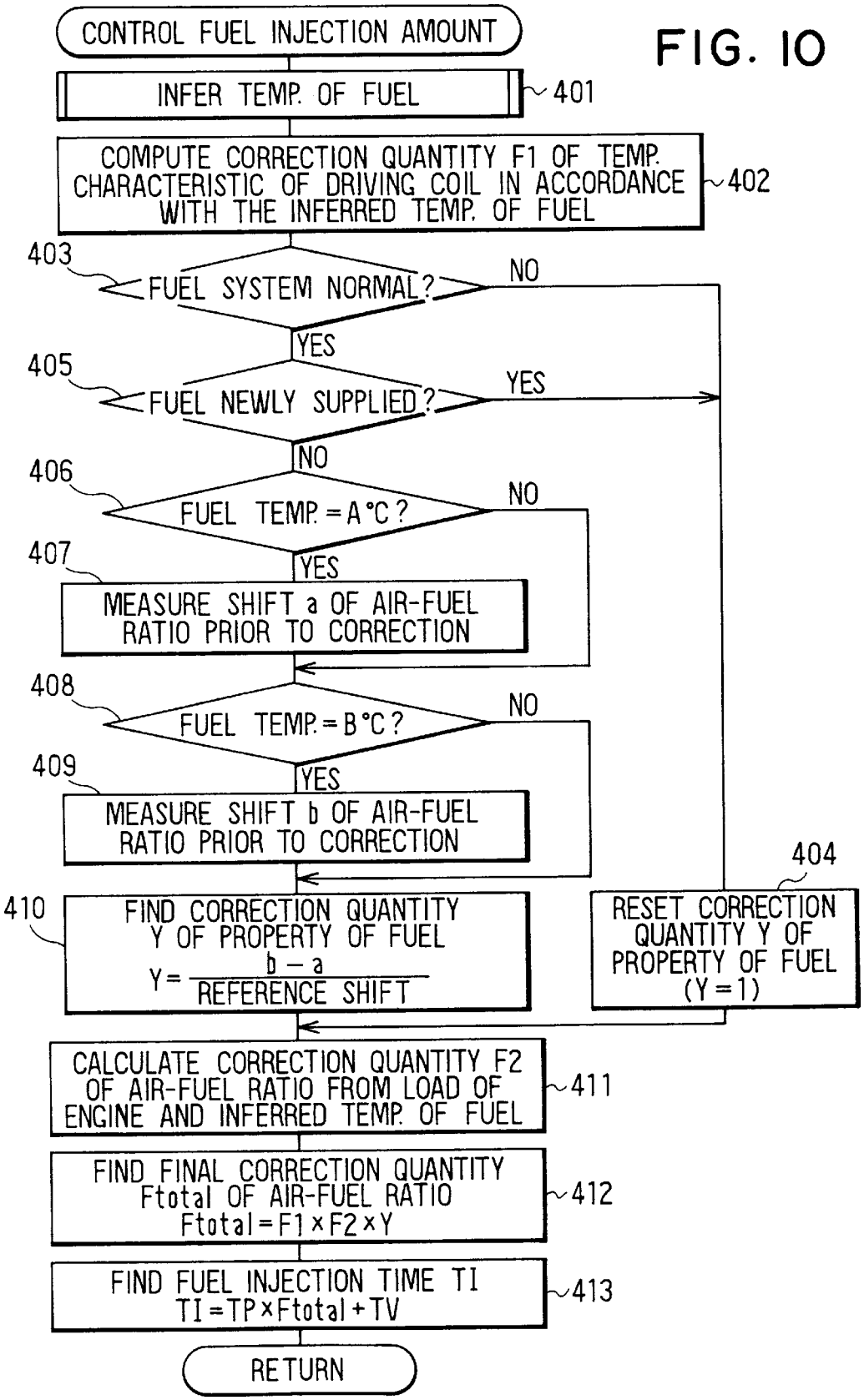
FIG. 10
CONTROL FUEL INJECTION AMOUNT
INFER TEMP. OF FUEL
401
COMPUTE CORRECTION QUANTITY F1 OF TEMP. CHARACTERISTIC OF DRIVING COIL IN ACCORDANCE WITH THE INFERRED TEMP. OF FUEL
402
403
FUEL SYSTEM NORMAL?
NO
YES
405
FUEL NEWLY SUPPLIED?
YES
NO
406
FUEL TEMP. = A °C ?
NO
YES
407
MEASURE SHIFT a OF AIR-FUEL RATIO PRIOR TO CORRECTION
408
FUEL TEMP. = B °C ?
NO
YES
409
MEASURE SHIFT b OF AIR-FUEL RATIO PRIOR TO CORRECTION
404
410
FIND CORRECTION QUANTITY Y OF PROPERTY OF FUEL
Y = (b − a) / REFERENCE SHIFT
RESET CORRECTION QUANTITY Y OF PROPERTY OF FUEL (Y = 1)
CALCULATE CORRECTION QUANTITY F2 OF AIR-FUEL RATIO FROM LOAD OF ENGINE AND INFERRED TEMP. OF FUEL
411
FIND FINAL CORRECTION QUANTITY Ftotal OF AIR-FUEL RATIO
Ftotal = F1 × F2 × Y
412
FIND FUEL INJECTION TIME TI
TI = TP × Ftotal + TV
413
RETURN

FUEL INJECTION CONTROL APPARATUS FOR AN INTERNAL COMBUSTION ENGINE

CROSS-REFERENCE TO RELATED APPLICATIONS

The present application is related to and claims priority in Japanese Patent Applications Hei. 9-314732 and 10-253167, the contents of which are incorporated herein by reference.

BACKGROUND OF THE INVENTION

1. Field of the Invention

The present invention relates generally to automobile fuel injection systems, and more particularly to a fuel injection control apparatus of an internal combustion engine that corrects fuel injection volume based on inferred fuel temperature.

2. Description of Related Art

If an internal combustion engine operates continuously under a heavy load for a long period of time, the temperature of the engine increases to a high value, and fuel evaporative emission, referred to hereafter as vapor, is produced in engine fuel pipes. If such vapor is generated, the fuel injection volume becomes smaller than a demanded value, resulting in a shift of the air-fuel ratio to the lean region. As is disclosed in Japanese Patent Laid-open No. Sho. 56-81230, to solve this problem, fuel temperature may be detected by using a fuel temperature sensor and, as the fuel temperature increases to a high value, the fuel injection volume may be corrected by increasing the volume. Alternatively, when the temperature of cooling water increases to a high value, the fuel pressure may be raised to correct the fuel injection volume by increasing the volume, as disclosed in Japanese Laid-open Application No. Hei. 5-125984.

However, a shift of the air-fuel ratio accompanying an increase in fuel temperature is not only attributed to a change in vapor generation volume, but also to a change in fuel density (the fuel itself, excluding vapor) attributed to fuel temperature. That is, a change in injected fuel temperature results in a change in injected fuel weight even if the volume of injected fuel remains the same. As a result, if the temperature of injected fuel changes, the air-fuel ratio is shifted.

To cope with a change in fuel density due to such a change in fuel temperature, the temperature of fuel may be detected by using a fuel temperature sensor and the fuel injection volume is corrected in accordance with a change in fuel density which is caused by a change in fuel temperature, as is disclosed in Japanese Patent Laid-open No. Sho. 52-133419.

As described above, a shift of the air-fuel ratio accompanying a change in fuel temperature is caused by two factors, namely, a change in generated vapor and a change in fuel density. In each of the solutions according to the conventional techniques described above, only one factor causing the shift is taken into consideration, making it impossible to correct a shift of the air-fuel ratio accompanying a change in fuel temperature, that is, a shift of the fuel injection volume, with a high degree of precision. In addition, when a fuel temperature sensor is required to detect the fuel temperature, increased system cost results.

SUMMARY OF THE INVENTION

It is thus an object of the present invention to provide a fuel injection control apparatus of an internal combustion engine that is capable of correcting a shift of the air-fuel ratio caused by a change in generated vapor, and a change in fuel density accompanying a change in fuel temperature, with a high degree of precision without the need for a fuel temperature sensor.

The present invention is a fuel injection control apparatus for an internal combustion engine that infers a temperature of fuel from a temperature of the internal combustion engine and a temperature of intake air. It may also infer fuel temperature from information used as a substitute for the temperature of the internal combustion engine and the temperature of intake air, such as the temperature of cooling water and atmospheric air temperature. The control apparatus focuses on the fact that the temperature of fuel supplied to fuel injection valves varies with a change in internal combustion engine temperature and a change in intake air.

Further, the apparatus corrects a shift of fuel injection volume, caused by a change in vapor generation volume, and a change in fuel density accompanying a change in fuel temperature, in accordance with the inferred fuel temperature.

In this configuration, since a temperature of fuel is inferred from a temperature of the internal combustion engine and a temperature of intake air which are detected as control parameters of the internal combustion engine, information on the temperature of the fuel can be obtained without adding a new sensor.

In addition, since a shift of an air-fuel ratio caused by a change in vapor generation volume and a change in fuel density accompanying a change in fuel temperature is corrected in accordance with an inferred temperature of the fuel, the shift of the air-fuel ratio can be corrected with good precision by taking all the causes of the shift of the air-fuel ratio accompanying the change in fuel temperature into consideration. As a result, it is possible to execute control of fuel injection with a high degree of precision with minimal effect on fuel temperature.

BRIEF DESCRIPTION OF THE DRAWINGS

Embodiments of the present invention will be described in detail by referring to the following diagrams wherein:

FIG. 5 is a diagram conceptually showing a map used for finding a correction coefficient of the air-fuel ratio from an inferred fuel temperature and an intake manifold pressure;

FIG. 8 is a flow diagram showing the flow of processing carried out by execution of a fuel temperature inferring program provided by a third embodiment;

FIG. 10 is a flow diagram representing the flow of processing carried out by execution of a fuel injection volume control program provided by a fourth embodiment.

DETAILED DESCRIPTION OF THE PREFERRED EMBODIMENTS

First Embodiment

Figure 1:
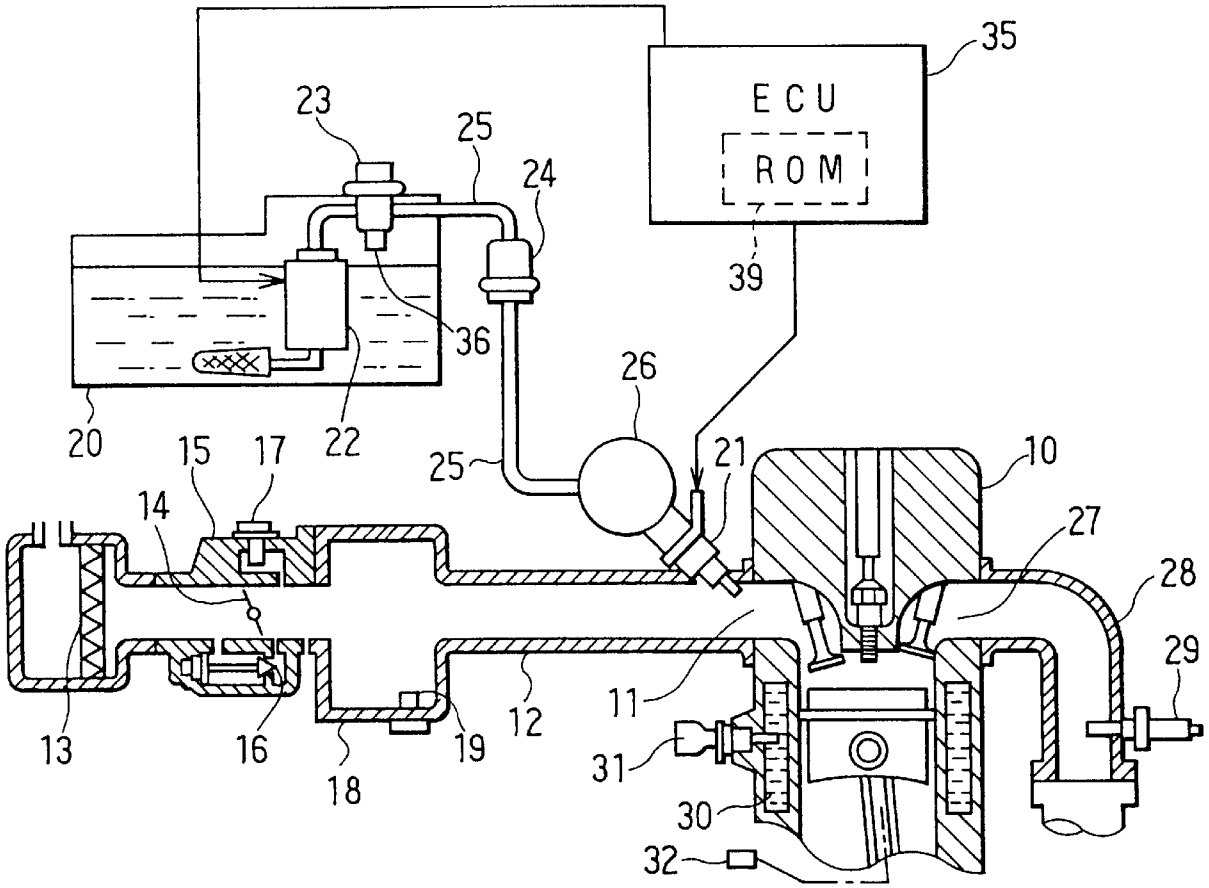
FIG. 1 is a diagram showing the configuration of an engine control system as a whole as implemented by a first embodiment of the present invention.

A first embodiment of the present invention will first be described, with reference to FIGS. 1–5. First, referring to FIG. 1, the configuration of an engine control system as a whole is explained. As shown in the figure, an air cleaner 13 is installed on the upstream side end of an intake pipe 12 which is connected on the downstream side thereof to an intake port 11 of an internal combustion engine 10. A throttle valve 14 is installed on the downstream side of the air cleaner 13. On a throttle body 15 accommodating the throttle valve 14, an idle speed control valve 16 for adjusting the volume of intake air bypassing the throttle valve 14, and an intake manifold pressure sensor 17 for detecting the intake manifold pressure, are installed. On the downstream side of the throttle body 15, a surge tank 18 is also provided. Inside the surge tank 18, an intake air temperature sensor 19 for sensing the temperature of intake air is provided.

A fuel injection valve 21 is provided in close proximity to the intake port 11 of each cylinder. The fuel injection valve 21 is used for injecting fuel, that is, gasoline, supplied from a fuel tank 20. Fuel in the fuel tank 20 is pumped up by a fuel pump 22 and then supplied to a delivery pipe 26 through a fuel pipe by way of a pressure regulator 23 and a fuel filter 24. The fuel is then distributed from the delivery pipe 26 to the fuel injection valves 21 of the cylinders. A back pressure chamber of the pressure regulator 23 is exposed to the atmosphere. Excess fuel supplied by the fuel pump 22 to the pressure regulator 23 is returned to the fuel tank 20 from a fuel return outlet 36 of the pressure regulator 23.

The fuel supply system described above does not require a return pipe for returning excess fuel from the delivery pipe 26 to the fuel tank 20, and thereby provides a returnless piping configuration wherein the fuel pipe 25 ends at the delivery pipe 26.

On the other hand, an air-fuel ratio sensor 29 for detecting the air-fuel ratio of exhausted gas is provided on an exhaust pipe 28 connected to an engine exhaust port 27. On the downstream side of this air-fuel ratio sensor 29, a three-way catalyst (not shown) for purifying the exhausted gas is provided. A water temperature sensor 31 for detecting the temperature of cooling water is installed on an engine-cooling water jacket 30. The revolution speed of the engine 10 is detected by monitoring the frequency of a pulse signal generated for each predetermined crank angle by a crank angle sensor 32.

Figure 4:
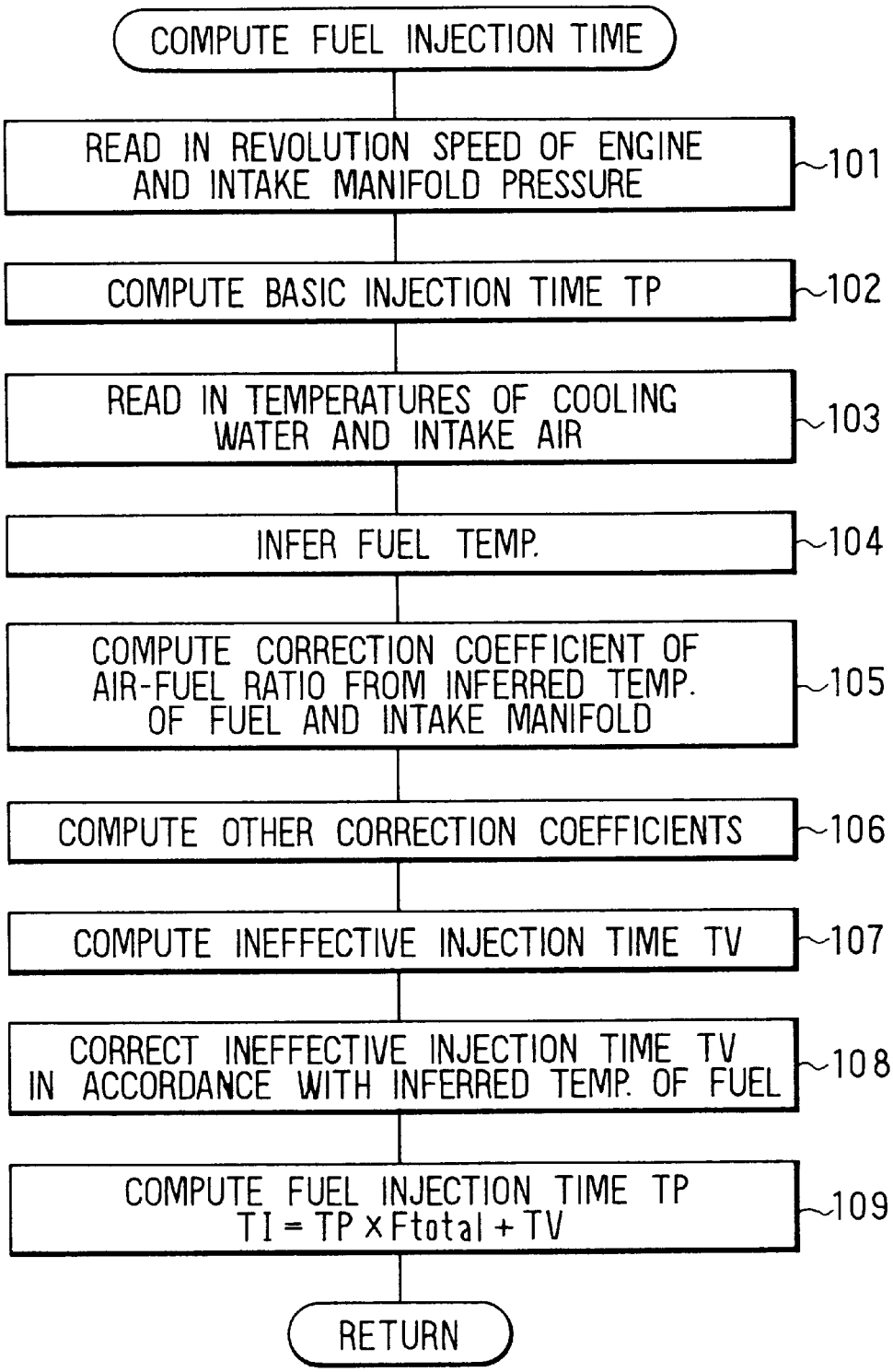
FIG. 4 is a flow diagram showing the flow of processing carried out by execution of a fuel injection time computing program provided by the first embodiment.

Signals output by the sensors described above are supplied to an engine control circuit 35 which is referred to hereafter simply as an ECU. The ECU 35 reads in signals representing intake air temperature, intake manifold pressure, cooling water temperature, engine revolution speed and an air-fuel ratio detected by the sensors, to control the fuel injection volumes (that is, the fuel injection times) of the fuel injection valves 21 by executing a fuel injection time computing program (FIG. 4). At that time, a shift of the air-fuel ratio, that is, a shift of the fuel injection volume, is corrected in accordance with the temperature of fuel supplied to the fuel injection valves 21. This processing is described as follows.

Figure 2:
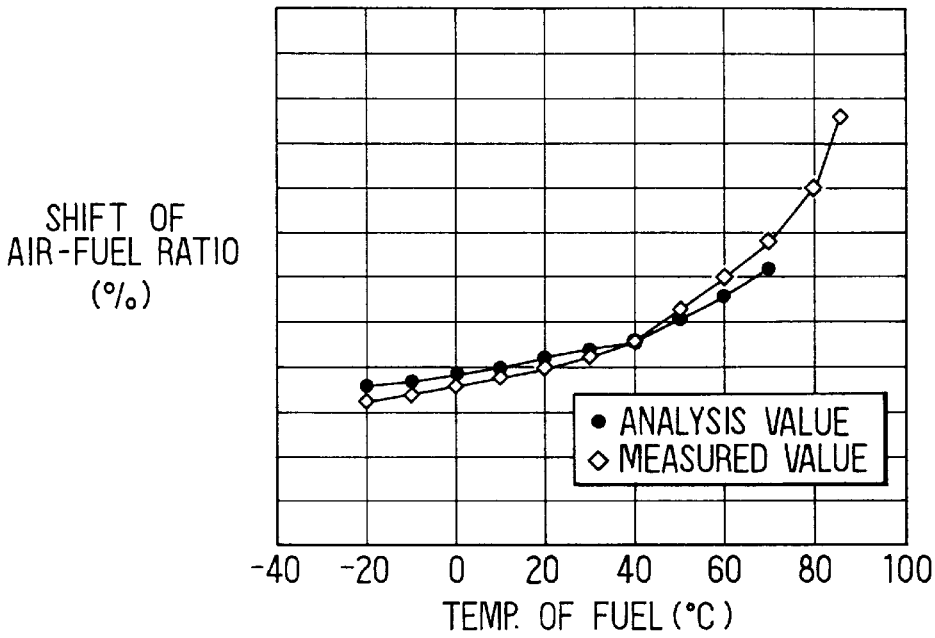
FIG. 2 is a diagram showing the relationship between fuel temperature and air-fuel ratio shift.

FIG. 2 is a diagram showing the relationship between fuel temperature and the air-fuel ratio shift. In the figure, a circle ● represents an analysis value and a diamond ◇ represents a measured value. A shift of the air-fuel ratio accompanying a change in fuel temperature is attributed to two factors, namely, a change in vapor generation volume and a change in fuel density. Vapor is generated at a high fuel temperature of at least 40 to 50 degrees Celsius. However, the fuel density changes without regard to the fuel temperature range, with the fuel density changing proportionally with fuel temperature change.

Thus, at a high fuel temperature of at least 40 to 50 degrees Celsius, the air-fuel ratio is shifted due to a change in generated vapor volume and a change in fuel density accompanying a change in fuel temperature. At a low fuel temperature below the range 40 to 50 degrees Celsius, on the other hand, the air-fuel ratio is shifted only because of a change in fuel density accompanying a change in fuel temperature.

Traditionally, since a fuel temperature sensor is required for detecting the fuel temperature, increased system cost due to the addition of the sensor is a problem. To solve this problem, in the embodiment, the fuel temperature is inferred from the intake air temperature, and the cooling water temperature can be used as a substitute for the engine temperature in accordance with Eq. (1) as follows:

$$\text{Fuel temperature} = K1 \times \text{Cooling water temperature} + K2 \times \text{Intake air temperature} \quad (1)$$

where symbols K1 and K2 are positive coefficients satisfying the relationship K1+K2=1. To put it concretely, K1 has a typical value in the range 0.2 to 0.3 whereas K2 has a typical value in the range 0.7 to 0.8.

Figure 3:
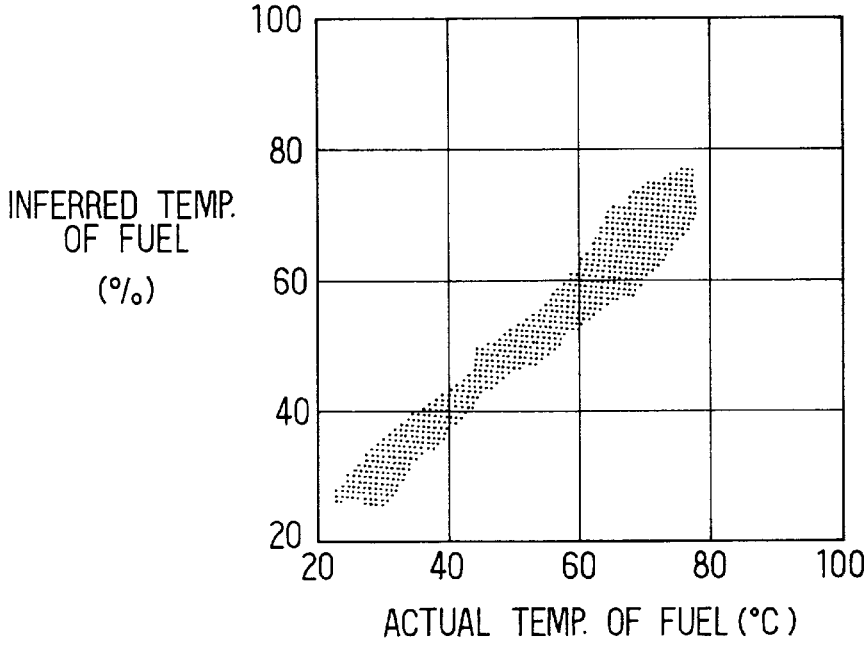
FIG. 3 is a diagram showing distribution of inferred fuel temperatures with respect to actual fuel temperatures.

As shown in FIG. 3, a fuel temperature inferred by using Eq. (1) is close to an actually measured fuel temperature. It is thus obvious that the fuel temperature can be inferred from the intake air temperature and the cooling water temperature with a high degree of accuracy.

It should be noted that Eq. (1) provides a good estimate of fuel temperature in a stable state of the engine 10. Thus, in a state immediately following an engine start or in a halted state, Eq. (1) can be further corrected to provide an even more precise estimate. Typically, coefficients K1 and K2 are set in accordance with the state of the engine 10 by using a map or a formula set in advance. In addition, values of the fuel temperature inferred by using Eq. (1) are further subjected to averaging processing. As an alternative, correction constants depending on the temperatures of the cooling water and intake air can be used in Eq. (1).

The ECU 35 executes the fuel injection time computing program of FIG. 4 stored in a ROM unit 39 immediately prior to injection timing to compute a fuel injection time TI used as a controlled value of the fuel injection volume as follows. As shown in the figure, at step 101, the program computes a revolution speed of the engine 10 from the frequency of a pulse signal generated by the crank angle sensor 32, and reads in an intake manifold pressure detected by the intake manifold pressure sensor 17. The program then advances to step 102 to compute a basic injection time TP from the revolution speed of the engine 10 and the intake manifold pressure by preferably using a map.

Then, the program proceeds to step 103 and reads in a temperature of the cooling water, detected by the water temperature sensor 31, and a temperature of intake air, detected by the intake air temperature sensor 19. Subsequently, the program continues to step 104 to infer fuel temperature from the cooling water temperature, and the intake air temperature by using Eq. (1). Incidentally, the processing at step 104 is carried out to play the role of a fuel temperature inferring means according to the invention. It should be noted that, in place of the intake air temperature, the atmospheric air temperature, closely related to the intake air temperature, can also be used.

The program then proceeds to step 105 to determine a correction coefficient of the air-fuel ratio from the inferred fuel temperature and the intake manifold pressure by using a map, such as the one shown in FIG. 5, which is set up in advance. This map is set up so that a characteristic thereof shows that, the higher the inferred fuel temperature, the larger the air-fuel ratio correction coefficient and, thus, the longer the fuel injection time. In addition, the lower the intake manifold pressure, that is, the larger the difference between the intake manifold pressure and the fuel pressure, the larger the correction coefficient of the air-fuel ratio and, thus, the longer the fuel injection time.

As described above, a shift of the air-fuel ratio accompanying a change in fuel temperature is attributed to a change in vapor generation volume and a change in fuel density, which are both caused by the change in fuel temperature. For this reason, in finding a correction coefficient of the air-fuel ratio, both a change in vapor generation volume and a change in fuel density accompanying a change in fuel temperature are taken into consideration. Also as described above, vapor is generated at a high fuel temperature of at least 40 to 50 degrees Celsius, and the density of fuel changes proportionally to a change in fuel temperature without regard to the temperature of the fuel. Thus, at a high fuel temperature of at least 40 to 50 degrees Celsius, both a change in vapor generation volume and a change in fuel density accompanying a change in fuel temperature are reflected in an air-fuel ratio correction coefficient. At a low fuel temperature, on the other hand, only a change in fuel density caused by a change in fuel temperature is reflected in a correction coefficient of the air-fuel ratio.

Subsequently, the program proceeds to step 106 to find a variety of other correction coefficients such as a correction coefficient associated with the temperature of the cooling water, an air-fuel ratio feedback correction coefficient, a learned correction coefficient, a correction coefficient associated with a heavy load and a high revolution speed and a correction coefficient associated with engine acceleration and deceleration. Subsequently, the program continues to step 107 to find an ineffective injection time TV from the voltage of a power supply, that is, the voltage of the battery, by using a map. Required to compensate for a response delay of the fuel injection valve 21, the ineffective injection time TV is a time which does not effectively contribute to injection of fuel. Because of the fact that, the lower the voltage of the power supply, the poorer the response characteristic of the fuel injection valve 21, the ineffective injection time TV is set at a large value for a low power supply voltage.

The program then proceeds to step 108 to correct the ineffective injection time TV in accordance with the inferred temperature of fuel. In this case, as the fuel temperature increases, the value to which the resistance of a driving coil of the fuel injection valve 21 also increases. As a result, the response characteristic of the fuel injection valve 21 decreases in quality. Therefore, it is desirable to correct the ineffective injection time TV by an increase in TV for a high inferred temperature of fuel.

It should be noted that the ineffective injection time TV can also be corrected in accordance with an inferred temperature of fuel by first finding a correction coefficient from the inferred temperature of fuel using a map, and then multiplying the ineffective injection time TV by this correction coefficient. As another alternative, a corrected value of the ineffective injection time TV may be found from a two-dimensional map representing a relation between the inferred temperature of fuel and the ineffective injection time TV.

Subsequently, the program proceeds to step 109 to compute a fuel injection time TI from the basic injection time TP, a representative correction coefficient Ftotal representing all the correction coefficients including the correction coefficient of the air-fuel ratio, and the ineffective injection time TV by using the following equation:

$$TI=TP\times Ftotal+TV$$

The term TP×Ftotal in the expression on the right-hand side of the above equation represents an effective injection time which effectively contributes to fuel injection.

The processing steps 105 to 109 are carried out to play the role of fuel injection volume correcting means according to the invention.

According to the embodiment described above, since a fuel temperature is inferred from the cooling water temperature and the intake air temperature, which are detected as traditional control parameters of the engine 10, it is possible to obtain information on the fuel temperature without the need to add a new sensor, thereby enabling system costs to be minimized. In addition, since a correction coefficient of the air-fuel ratio is found by taking a change in vapor generation volume and a change in fuel density caused by a change in fuel temperature into consideration, a shift of the air-fuel ratio can be corrected with a high degree of precision by considering all causes of the shift of the air-fuel ratio which accompany the change in fuel temperature. As a result, it is possible to execute high-precision control of fuel injection that is minimally affected by a change in fuel temperature.

As described above, at step 105, a correction coefficient of the air-fuel ratio is found from an inferred temperature of fuel and an intake manifold pressure by using a map shown in FIG. 5. It should be noted, however, that a correction coefficient of the air-fuel ratio can also be found from an inferred temperature of fuel only by using typically a map.

In addition, at step 108, the ineffective injection time TV is corrected in accordance with the inferred fuel temperature. It is worth noting, however, that the processing of this step can be omitted. Instead, the processing of step 105 may be carried out to find a correction coefficient of the air-fuel ratio that also reflects a variation in ineffective injection time TV caused by a change in fuel temperature. That is, the effective injection time is corrected in accordance with a change in inferred fuel temperature by taking a variation in ineffective injection time TV into consideration.

As described above, in the first embodiment, the effective injection time is corrected in accordance with a change in inferred fuel temperature. It should be noted, however, that the fuel injection volume varies also due to a change in fuel pressure. Thus, it is also desirable to correct the pressure of fuel in accordance with a change in inferred fuel temperature.

Second Embodiment

Figure 6:
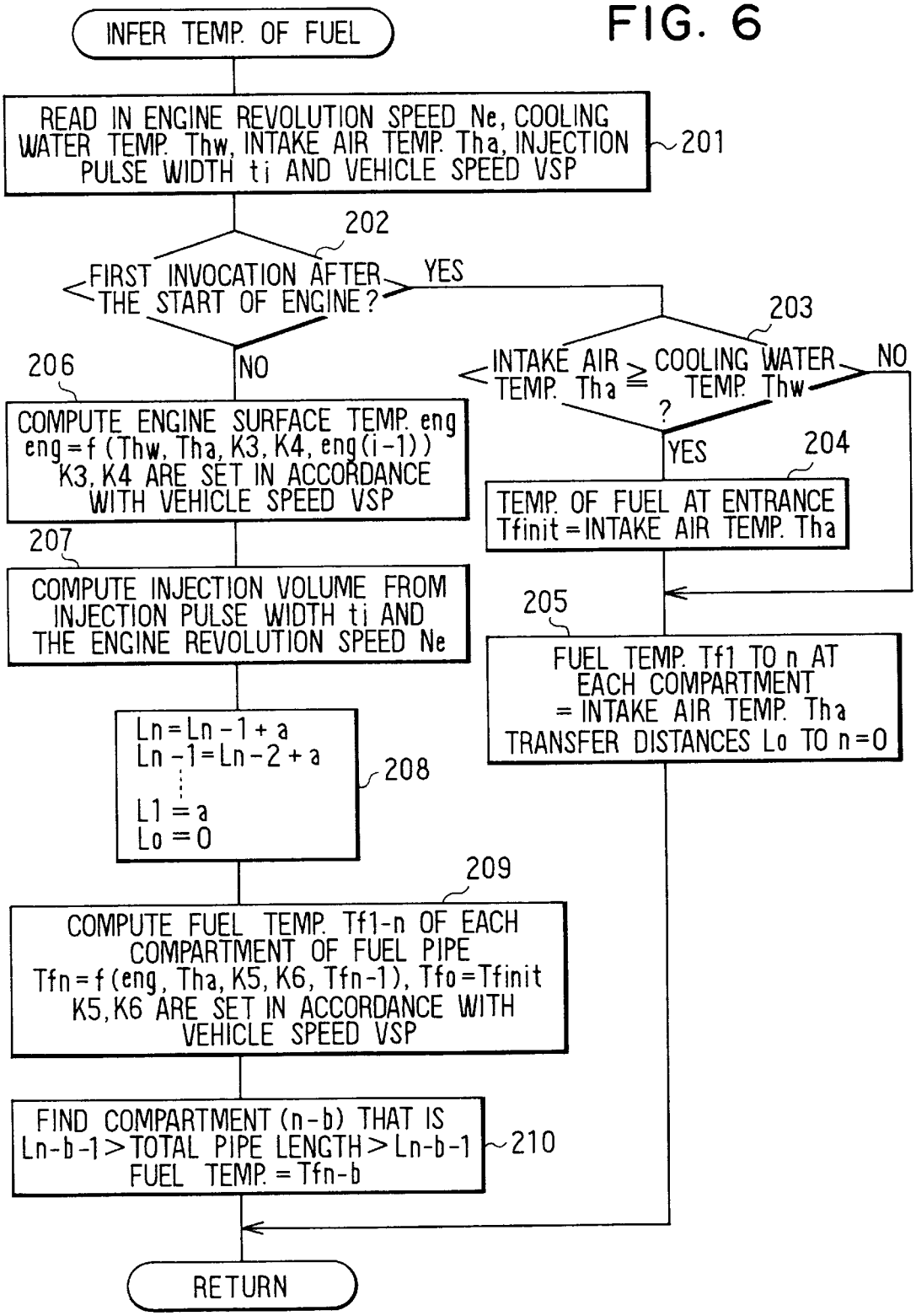
FIG. 6 is a flow diagram showing the flow of processing carried out by execution of a fuel temperature inferring program provided by a second embodiment.

In the first embodiment described above, the fuel temperature is computed as a linear function of intake air temperature and cooling water temperature, the latter being a variable serving as substitute information for the temperature of the engine 10. In the second embodiment of the present invention, on the other hand, a fuel temperature inferring program shown in FIG. 6 is executed to infer a temperature of an indirect element, such as the surface of the engine 10, which transfers heat to fuel supplied to the fuel injection valve 21. The temperature of the indirect element is inferred from a temperature of the engine 10 and a temperature of intake air, or information that can be used as substitutes for the engine temperature and the intake air temperature. Then, fuel temperature is inferred by using a fuel temperature inference model set up by considering the indirect element temperature, intake air temperature, the relationship between the positions of fuel inside the fuel pipe and the indirect element (that is, the surface of the engine 10), the fuel transfer velocity (or the distance traveled by the fuel in a unit time) as well as the speed of the vehicle.

The following is a description of processing to infer fuel temperature according to the above method by execution of the fuel temperature inferring program shown in FIG. 6. Incidentally, this program is executed at predetermined time intervals, or at intervals corresponding to a predetermined crank angle, to infer fuel temperature according to the present invention. When this program is invoked, first, at step 201, an engine revolution speed Ne, a cooling water temperature Thw, an intake air temperature Tha, an injection pulse width ti and a vehicle speed VSP are read in. The program then proceeds to step 202 to determine whether the current invocation is the first after the start of the engine 10.

If the current invocation is the first one, the flow of the program proceeds to a step 203 to determine whether the intake air temperature Tha is at least equal to the cooling water temperature Thw to determine whether the engine start was a cold start. If the intake air temperature Tha is found at least equal to the cooling water temperature Thw (Tha≧Thw), the program continues to step 204, where the intake air temperature Tha is set as a fuel temperature at a fuel pipe engine entrance, referred to hereafter simply as an entrance fuel temperature Tfinit. Then, the program proceeds to step 205 where the cooling water temperature Thw is set as fuel temperatures Tf1 to Tfn at compartments 1 to n located after the engine entrance of the fuel pipe. At the same time, total transfer distances L0 to Ln of fuel at compartments 0 to n respectively are all set at 0.

It should be noted that, in the fuel temperature inferring model provided by the second embodiment, the temperature of fuel in the pipe outside the engine is assumed to be equal to the intake air temperature, that is, atmospheric air temperature, due to the cooling effect produced by moving vehicle-generated blown air. Transfers of heat between fuel in compartments 0 to n of the fuel pipe inside the engine room and the indirect element, that is, the surface of the engine 10, as well as the atmosphere are modeled. In addition, the lengths of compartments 0 to n of the fuel pipe inside the engine room are variable lengths which change depending on total transfer distances L0 to Ln. The number of compartments (n) is set at a sufficiently large value.

If the start of the engine is determined to be a warm restart (Tha<Thw) at step 203, on the other hand, the program continues from step 203 to step 205, bypassing step 204. As described above, at step 205, Tf1~Tfn=Tha and L0 to Ln=0 are set. In this case, as an entrance fuel temperature Tfinit, a backup value obtained in the immediately preceding invocation, that is, an entrance fuel temperature used immediately prior to halting of the engine 10, is used.

In the case of a second or subsequent invocation of this program after engine start, on the other hand, the program proceeds from step 202 to step 206 where an engine surface temperature eng is computed from the cooling water temperature Thw serving as a substitute for the temperature of the engine 10, the intake air temperature Tha, as well as coefficients K3 and K4 by using Eq. (2) as follows:

eng =K3 X Thw +K4 X Tha (2)

$$eng=K3\times Thw\,{}^{\circ}K4\times Tha \tag{2}$$

where the coefficients K3 and K4 are set in accordance with the vehicle speed VSP by using a map or other programmed routine.

As an alternative, the engine surface temperature eng can be computed by using Eq. (3) as follows:

$$eng=K3'\times(eng(i-1)-Thw)+K4'\times\{eng(i-1)-Tha\} \tag{3}$$

where notation eng(i−1) is the temperature of the engine surface calculated during the immediately preceding invocation, whereas the symbols K3' and K4' are coefficients which are set in accordance with the vehicle speed VSP by using a map or other programmed routine. Eq. (3) given above is an equation to find an engine surface temperature eng by an averaging process.

The program then proceeds to step 207 to compute an injection volume per unit time, that is, per period of invocation of this program, from the injection pulse width ti and the engine revolution speed Ne. Then, a fuel transfer distance per unit time, that is, per period of invocation of this program, is computed from this injection volume and the area of the opening cross section of the fuel pipe. Subsequently, the program continues to step 208 to compute total transfer distances L0 to Ln of compartments 0 to n of the fuel pipe respectively from the unit fuel transfer distance a found at immediately preceding step 207.

Then, the program proceeds to step 209 to compute fuel temperatures Tf0 to Tfn of compartments 0 to n of the fuel pipe respectively from the engine surface temperature eng, the intake air temperature Tha as well as the coefficients K5 and K6 by using the following equations.

$$Tf0=Tfinit$$

$$Tf1\sim n=K5\times eng+K6\times Tha \tag{4}$$

where notation Tf1−n represents the fuel temperatures Tf0 to Tfn.

Coefficients K5 and K6, as well as total transfer distances L0 to Ln, that is, the relationship between the surface of the engine 10 and compartments 0 to n, used in Eq. (4) are determined from the vehicle speed VSP by using a map or other programmed routine.

As an alternative, fuel temperatures Tf1~n of compartments 1 to n respectively can be computed by using Eq. (5) as follows:

$$Tf1\sim n=K5'\times(Tf1\sim n(i-1)-eng)+K6'\times(Tf1\sim n(i-1)-Tha) \tag{5}$$

where notation Tf1~n(i−1) represents fuel temperatures obtained during the immediately preceding invocation, and symbols K5' and K6' are coefficients which are set in accordance with the total transfer distances L0 to Ln and the vehicle speed VSP by using typically a map or other programmed routine. Eq. (5) given above is an equation utilized to find fuel temperatures Tf1~n by an averaging process.

Subsequently, the program proceeds to step 210 to find a fuel temperature at a location of the fuel injection valve 21 as follows. In the case of compartment (n−b) with a fuel transfer distance Ln−b exceeding the total length of the fuel pipe to the engine, the following relation holds true:

$$Lnb > \text{Total pipe length} > Ln-b-1$$

where notation Ln−b−1 represents the fuel transfer distance of compartment (n−b−1). The fuel temperature Tfn−b of compartment (n−b) is taken as a temperature of fuel at a location of the fuel injection valve 21.

In the second embodiment described above, the temperature of the indirect element (that is, the surface of the engine 10) transferring heat to fuel supplied to the fuel injection valve 21 is inferred from the temperature of the engine, that is, the temperature of the cooling water, and the temperature of intake air. Then, the temperature of fuel is inferred by using a fuel temperature inference model which simulates transfers of heat between the indirect element and fuel in the fuel pipe. As a result, the temperature of fuel can be inferred with high accuracy considering a heat propagation route, by which the temperature of the engine 10 and the temperature of intake air, that is, the air temperature of the atmosphere, change the temperature of fuel.

Figure 7:
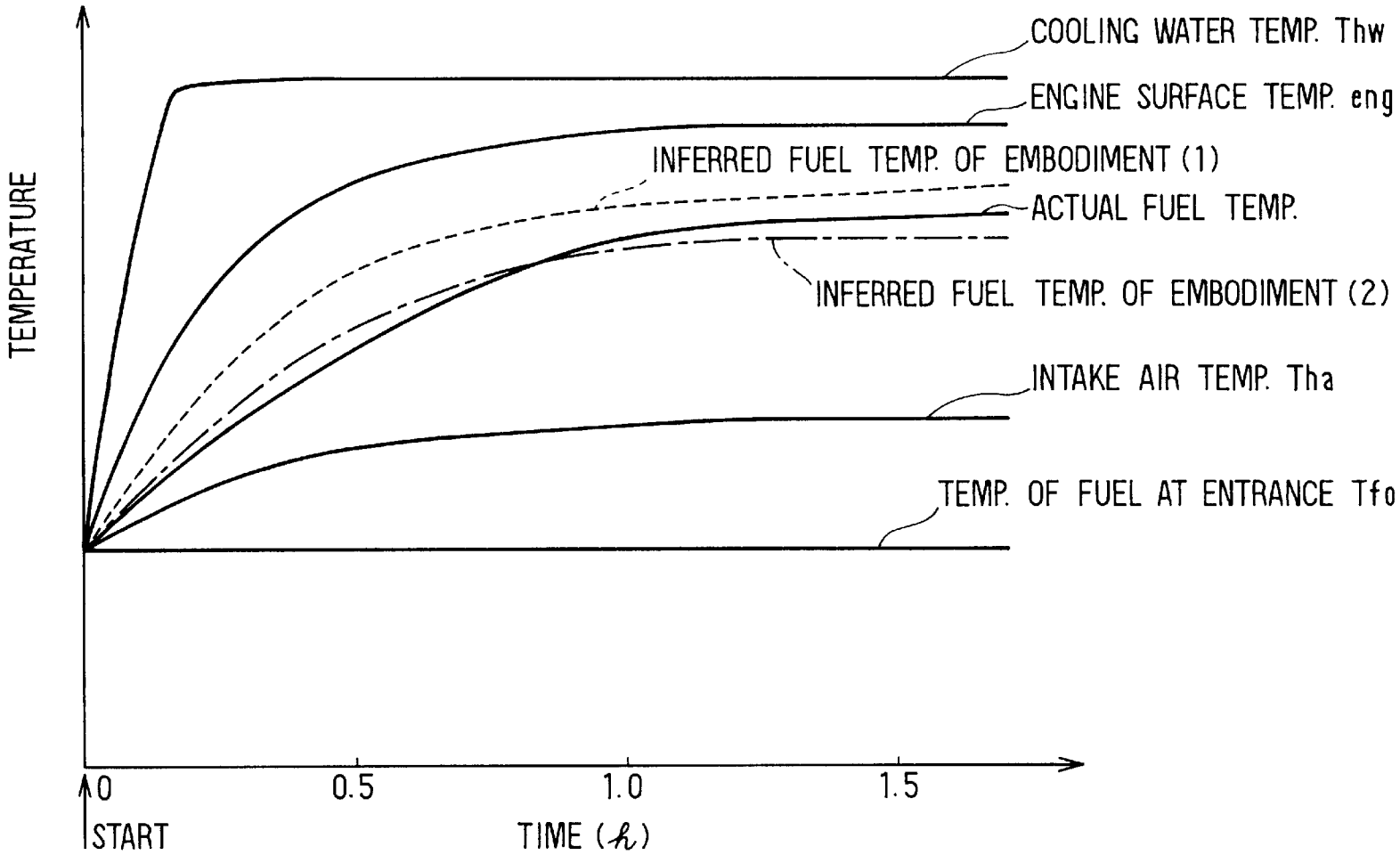
FIG. 7 illustrates timing diagrams showing changes in fuel temperature inferred by the first and second embodiments, changes in cooling water temperature, changes in intake air temperature, in actual fuel temperature and changes in entrance fuel temperature over time.

For this reason, as is shown in FIG. 7, the temperature of fuel inferred by the second embodiment is closer to the actual temperature of fuel than the temperature of fuel computed by the first embodiment directly from the temperature of the cooling water and the temperature of intake air.

Third Embodiment

In the fuel temperature inference model of the second embodiment, the compartments of the fuel pipe each have a variable length. In the third embodiment, on the other hand, the compartments of the fuel pipe each have a fixed length. In the third embodiment, fuel temperature is inferred by execution of a fuel temperature inferring program shown in FIG. 8 as follows.

The fuel temperature inferring program shown in FIG. 8 is invoked at predetermined intervals of, for example, 1 second. When this program is invoked, a variety of coefficients of a fuel temperature inference model are calculated at step 301. The flow of the program then proceeds to step 302 to determine whether the current invocation is the first invocation after the start of the engine 10.

If the current invocation is the first one, the program proceeds to step 303 at which an initial value of the atmospheric temperature Otmp is set. At that time, in the case of a cold engine start, the intake air temperature Tha is set as an initial temperature of the atmospheric temperature Otmp. In the case of a warm engine restart, on the other hand, a backup value obtained from the immediately preceding invocation. In other words, atmospheric air temperature detected immediately prior to halting of the engine 10, is set as an initial temperature of the atmospheric temperature Otmp. Then, the program proceeds to step 304 where the initial value of the fuel consumption volume vol is set at 0. The program then continues to step 305 to compute an initial value of the engine surface temperature eng as a function of parameters such as the cooling water temperature Thw, the intake air temperature Tha and a coefficient Ka as follows.

$$\text{Initial value of eng} = f(\text{Thw, Tha, Ka})$$

where the coefficient Ka represents a ratio of an effect of the cooling water temperature Thw to an effect of the intake air temperature Tha on the engine surface temperature eng.

Subsequently, the program continues to step 306 to compute initial values of the fuel temperatures Tf1−n of compartments 1 to n of the fuel pipe respectively from the initial value of the engine surface temperature eng and the intake air temperature Tha by using coefficients associated with locations of compartments 1 to n.

In the case of a second or subsequent invocation of this program after engine start, on the other hand, the program proceeds from step 302 to step 307 at which the atmospheric temperature Otmp is updated to the intake air temperature Tha. Subsequently, the program proceeds to step 308 to carry out an averaging process on the fuel consumption volume per unit time, that is, per period of invocation of this program, from the injection pulse width ti and the engine revolution speed Ne as follows:

$$Vol = f(\text{ti, Ne, } Vol(i-1))$$

Then, the program proceeds to step 309 where an engine surface temperature eng is computed from the cooling water temperature Thw and the intake air temperature Tha in the same way as the second embodiment described before.

The program then continues to step 310 to determine whether the fuel consumption volume vol is smaller than a predetermined value, for example, the volume of a compartment of the fuel pipe. If the fuel consumption volume vol is found to be less than the predetermined value, the program proceeds to step 311 where the fuel temperatures Tf1~n of compartments 1 to n of the fuel pipe are computed from the engine surface temperature eng and the intake air temperature Tha by using coefficients Kb and Kc associated with the positions of compartments 1 to n as follows:

$$Tf1-n = f(eng, Tha, Kb, Kc)$$

where the coefficient Kb represents a ratio of an effect the intake air temperature Tha to an effect of the engine surface temperature eng on the temperature of fuel whereas the coefficient Kc is set in accordance with the vehicle speed VSP.

If the fuel consumption volume vol is determined to be equal to or greater than the predetermined value at step 310, on the other hand, the program advances to step 312 where the fuel temperatures Tf1~n of compartments 1 to n of the fuel pipe are set at the same values as the fuel temperatures Tf1~n(i−1) of compartments 1 to n respectively inferred in the immediately preceding invocation. To be more specific, Tf2=Tf1(i−1), Tf3=Tf2(i−1), - - - , Tfn=Tfn−1(i−1) are set. In this case, the fuel temperature Tf1 of the first compartment from the engine entrance is set at the atmospheric temperature Otmp which was updated at step 307.

After fuel temperatures Tf1~n of compartments 1 to n of the fuel pipe respectively are computed at the step 311 or 312 as described above, the program proceeds to step 313 where a fuel temperature Tinj at the edge of the fuel injection valve 21 is computed as a function of parameters, such as a fuel temperature Tfn of compartment n at the rear end of the fuel pipe, that is, the terminating end of the delivery pipe, the engine surface temperature eng and a coefficient Kd as follows:

$$Tinj = f(eng, Tfn, Kd)$$

where the coefficient Kd represents a ratio of an effect of the engine surface temperature eng to an effect of the fuel temperature Tfn of compartment n at the rear end of the fuel pipe on the fuel temperature Tinj at the edge of the fuel injection valve 21.

Much like the second embodiment, in the third embodiment described above, the fuel temperature is inferred by using a fuel temperature inference model which considers the temperature of the indirect element (that is, the surface of the engine 10) transferring heat to fuel supplied to the fuel injection valve 21. As a result, the fuel temperature can be inferred with a high degree of accuracy considering a heat propagation route, by which the temperature of the engine 10 and the temperature of intake air, that is, the air temperature of the atmosphere, change the temperature of fuel.

It should be noted that, in the case of the third embodiment, since the fuel temperature Tinj at the edge of the fuel injection valve 21 is inferred, a shift of the air-fuel ratio caused by a change in fuel density and a change in vapor generation volume of fuel at the edge of the fuel injection valve 21 can be corrected with a higher degree of precision. However, the fuel temperature Tfn of compartment n at the rear end of the fuel pipe can also be used as fuel temperature at the edge of the fuel injection valve 21.

Fourth Embodiment

Figure 9:
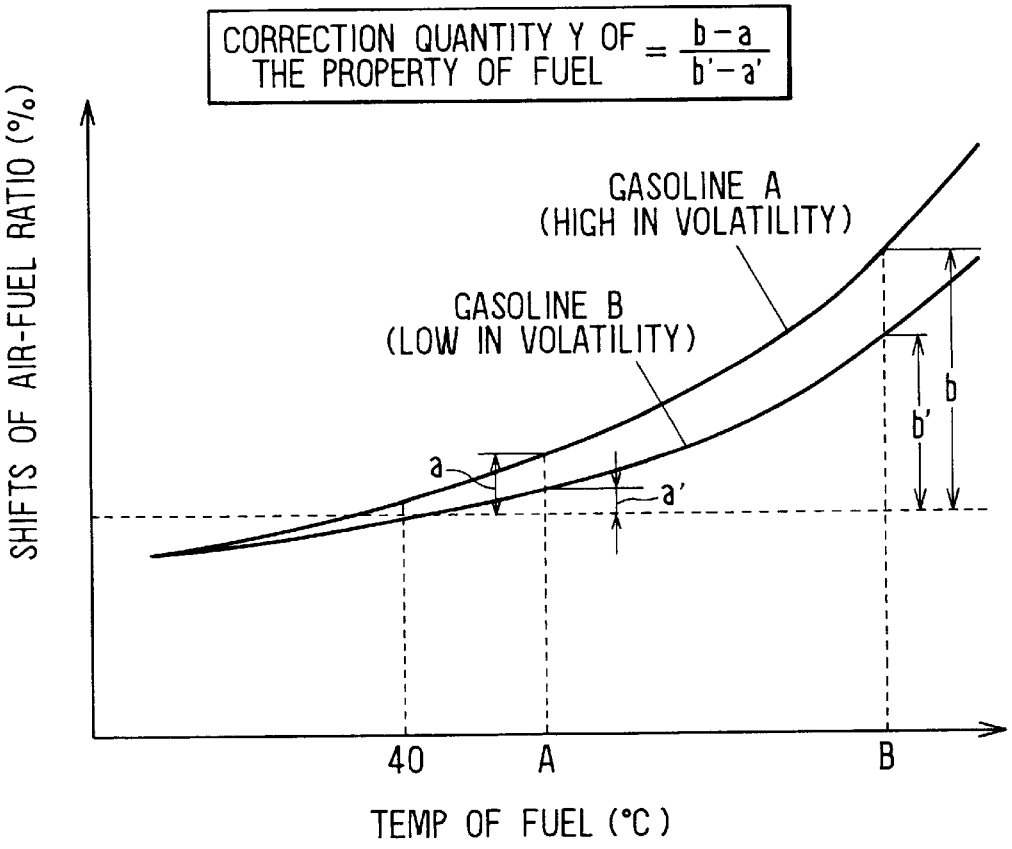
FIG. 9 is an explanatory diagram showing differences in air-fuel ratio shift caused by differences in fuel property.

A change in fuel density and a change in vapor generation volume accompanying a change in fuel temperature are also affected by the property of fuel. For example, the higher the volatility of the fuel, the larger the change in fuel density and the change in vapor generation volume accompanying a change in fuel temperature. As a result, a shift of the air-fuel ratio of gasoline A with a higher volatility is greater than that of gasoline B with a lower volatility, as shown in FIG. 9. As shown in the figure, the shifts of the air-fuel ratios of gasoline A and gasoline B as well as the difference between them increase gradually with the rise of the fuel temperature. Thus, by correcting a shift of the air-fuel ratio with the property of the fuel taken into consideration in addition to the temperature of the fuel, the control accuracy of the air-fuel ratio can be further improved.

For the reason described above, in a fourth embodiment, the present invention corrects fuel injection volume by taking the property of the fuel into consideration, in addition to the temperature of the fuel, through execution of a fuel injection volume control program shown in FIG. 10. Processing carried out by execution of the fuel injection volume control program is explained by referring to a flow diagram shown in FIG. 10 as follows.

As shown in FIG. 10, the fuel injection volume control program begins with step 401 at which fuel temperature is inferred by adopting one of the methods provided by the first to third embodiments. The program then proceeds to step 402 at which a correction quantity F1 of the temperature characteristic of a driving coil of the fuel injection valve 21 is computed in accordance with the inferred fuel temperature. The correction quantity F1 of the coil temperature characteristic is a correction quantity of the air-fuel ratio to compensate for a change in response characteristic of the fuel injection valve 21 accompanying a change in temperature of the driving coil of the fuel injection valve 21.

Next, the processing proceeds to step 403 to determine whether the fuel system including the fuel injection valves 21 and the air-fuel ratio sensor (or the oxygen concentration sensor) 29 is normal, or if an abnormality exists. If the fuel system is determined to be abnormal at step 403, the program continues to step 404 without determining the property of fuel. At step 404, a correction quantity Y of the property of fuel is set at 1 (Y=1).

If the fuel system is determined to be normal at step 403, on the other hand, the program continues to step 405 to determine whether fuel has been newly supplied to the fuel tank 20 by checking a fuel gauge signal output. If fuel is determined to have been newly supplied at step 405, the program proceeds to step 404, as the property of the new fuel may be different from the previous one. At step 404, the correction quantity Y of the property of fuel is set at 1 (Y=1).

If fuel is determined to have not been newly supplied at step 405, on the other hand, the program proceeds to step 406, and to subsequent steps, to determine a correction quantity Y of the property of fuel. More particularly, first, at steps 406 and 407, a shift a of the air-fuel ratio prior to correction at a fuel temperature of A degrees Celsius, where A is typically 50, is measured. Then, at steps 408 and 409, a shift b of the air-fuel ratio prior to correction at a fuel temperature B degrees Celsius higher than A, where B is typically 80, is measured. The program then goes on to step 410 where a correction quantity Y of the property of fuel is found by using an equation given below. The correction quantity Y is stored in a nonvolatile storage means such as a buffer RAM.

$$Y=(b-a)/\text{Reference shift}$$

where the reference shift is a difference (b'−a') between a shift a' of the air-fuel ratio prior to correction at the fuel temperature A degrees Celsius and a shift b' of the air-fuel ratio prior to correction at the fuel temperature B degrees Celsius for the reference fuel.

After a correction quantity Y of the property of fuel has been set at step 410 or reset at step 404, the program proceeds to step 411 where a correction quantity F2 of the air-fuel ratio is calculated from the load of the engine 10 and the inferred fuel temperature. The program then continues to step 412 where a final correction quantity Ftotal of the air-fuel ratio is found as a product of a correction quantity F1 of the air-fuel ratio, the correction quantity F2 calculated from the load of the engine 10 and the inferred temperature of the fuel, and the correction quantity Y of the property of the fuel as follows:

$$Ftotal=F1\times F2\times Y$$

Subsequently, the processing goes on to step 413 where a fuel injection time TI is found by using the final correction quantity Ftotal of the air-fuel ratio in the following equation:

$$TI=TP\times Ftotal+TV$$

where notation TP is a basic injection time and notation TV is an ineffective injection time.

In the fourth embodiment described above, a shift of the fuel injection volume is corrected by taking the property of the fuel into consideration in addition to the inferred fuel temperature. As a result, fuel injection can be controlled with high precision through consideration of a change in fuel density and in vapor generation volume accompanying a change in fuel property due to replenishment of new fuel and a change in fuel property over time.

In addition, since a correction quantity Y of the property of fuel calculated at step 410 is stored in a nonvolatile storage means such as a backup RAM, the fuel injection volume can be corrected by using the correction quantity Y of the property of fuel stored in a nonvolatile storage means until the property of the fuel can be determined after the engine 10 is started. As a result, it is possible to control fuel injection by taking the property of fuel into consideration from the time the engine 10 is started.

Fuel may be replenished, changing the property of fuel while the engine 10 is not running. In this case, when the replenishment of new fuel is detected at step 405, data of the correction quantity Y of the fuel property is reset at step 404. As a result, in the event of a change in fuel property caused by replenishment of new fuel, it is possible to prevent the fuel injection volume from being erroneously corrected by using the data of the correction quantity Y of the fuel property which was calculated before the replenishment of the new fuel.

As described above, in the fourth embodiment, a correction quantity Y of the property of fuel is calculated from a difference between shifts of the air-fuel ratio at two different temperatures of fuel. It should be noted that a correction quantity Y of the property of fuel can also be calculated from a ratio of a shift of the air-fuel ratio at a temperature of fuel, that is, at the temperature B, to a shift of the air-fuel ratio of the reference fuel. As another alternative, first of all, a relation among the temperature of fuel, the property of the fuel and the shift of the air-fuel ratio is found empirically in advance and represented by a map or other programmed function. Then, a property of fuel is determined from an inferred temperature of the fuel and a shift of the air-fuel ratio by using the map or the function. Finally, a correction quantity Y for the determined property of the fuel is calculated.

Fifth Embodiment

When a vehicle is driven on high land where the atmospheric pressure is low, the back pressure applied to the fuel in the fuel tank is also low as a result, making vapor easy to evaporate. For this reason, when the vehicle is driven at a low atmospheric pressure, the shift of the fuel injection volume or the shift of the air-fuel ratio tends to increase in comparison with driving under a standard atmospheric pressure.

Figure 11:
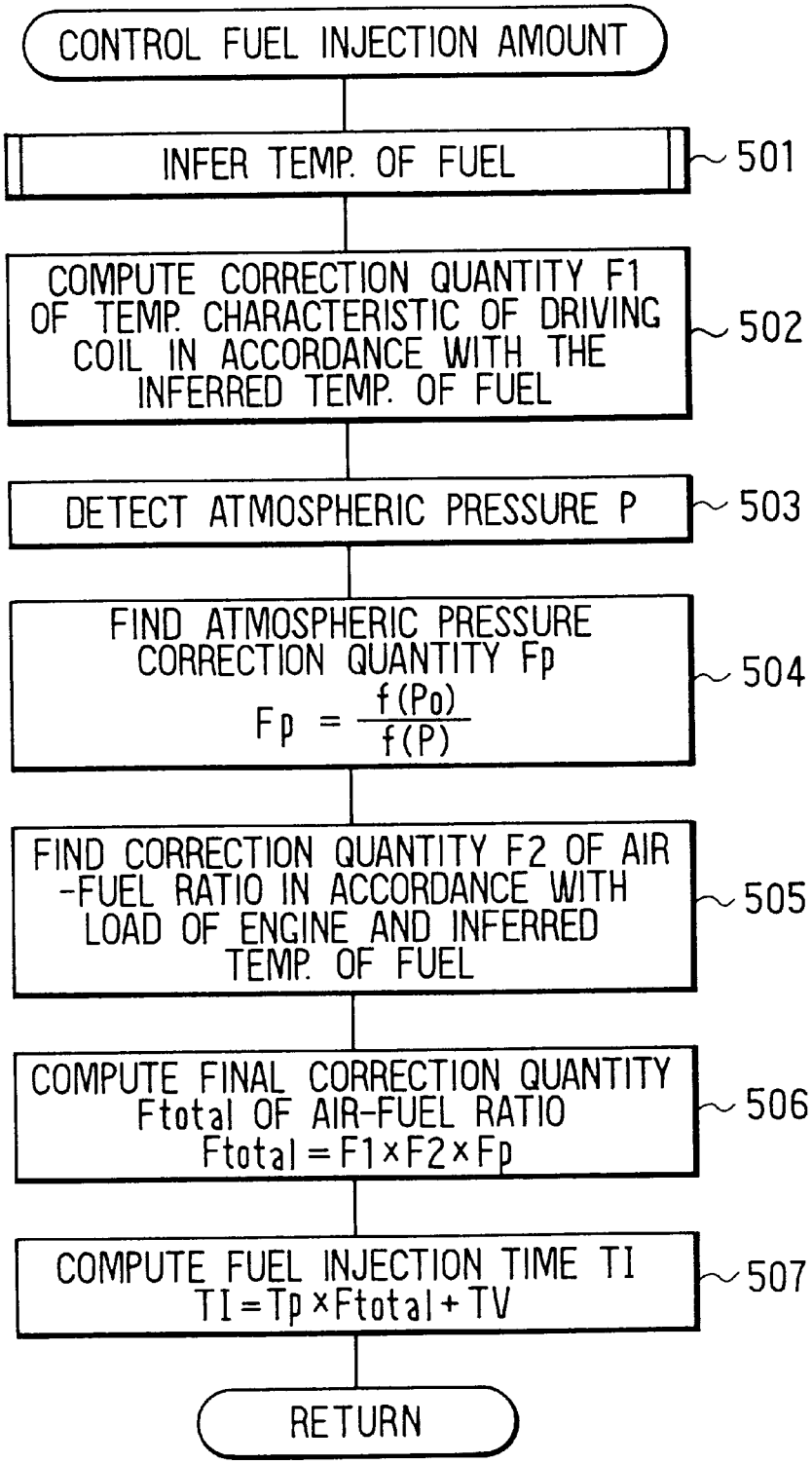
FIG. 11 is a flow diagram representing the flow of processing carried out by execution of a fuel injection volume control program provided by a fifth embodiment.

As a measure taken to counter this phenomenon, in a fifth embodiment, the fuel injection volume (or the air-fuel ratio) is corrected in accordance with the atmospheric pressure by execution of a fuel injection volume control program shown in FIG. 11.

The fuel injection volume control program shown in FIG. 11 begins with step 501 at which a temperature of fuel is inferred. The program then goes on to step 502 where a correction quantity F1 of the coil temperature characteristic according to the inferred temperature of the fuel is computed. Then, the program proceeds to step 503 where the atmospheric pressure P is detected by using an atmospheric pressure sensor. It should be noted that, if the atmospheric pressure sensor is not available, the atmospheric pressure can be found by typically detecting the pressure of intake air with a throttle opening maintained at a predetermined value or by a calculation using the pressure of intake air and the operating state of the engine 10.

Subsequently, the program continues to step 504 where an atmospheric pressure correction quantity Fp is found as a ratio of a standard atmospheric pressure Po (or its function f (Po)) to a present atmospheric pressure P (or its function (f (P)) as follows:

$$Fp=Po/P \text{ or } Fp=f(Po)/f(P)$$

As an alternative, an atmospheric pressure correction quantity Fp is found from the standard atmospheric pressure Po and the present atmospheric pressure P by using a map or other programmed function, with the standard atmospheric pressure Po and the present atmospheric pressure P taken as parameters.

The program then proceeds to step 505 where a correction quantity F2 of the air-fuel ratio is found in accordance with a load of the engine 10 and an inferred fuel temperature. Then, the program advances to step 506 where a final correction quantity Ftotal of the air-fuel ratio is computed as a product of the correction quantity F1 of the coil temperature characteristic, the correction quantity F2 of the air-fuel ratio dependent on the engine load, and the inferred temperature of fuel and the correction quantity Ftotal of the atmospheric pressure as follows:

$$Ftotal=F1\times F2\times Fp$$

Finally, the program proceeds to step 507 where a fuel injection time TI is computed by using this final quantity correction of the air-fuel ratio Ftotal in accordance with the following equation:

$$TI=TP\times Ftotal+TV$$

where notation TP is a basic injection time and notation TV is an ineffective injection time.

In the fifth embodiment described above, because the shift of fuel injection volume is corrected by considering the air pressure of the atmosphere in addition to the inferred fuel temperature, fuel injection can be accurately controlled by factoring a change in vapor generation volume caused by a change in atmospheric pressure into consideration.

It should be noted that the present invention is not limited to a fuel supply system with a piping configuration having no return. That is, the present invention can also be applied to a fuel system with a pipe configuration wherein excess fuel is returned from the delivery pipe 26 to the fuel tank 20 through a return pipe.

Further, while the above description constitutes the preferred embodiment of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

What is claimed is:

1. A fuel injection control apparatus for an internal combustion engine, said apparatus comprising:

means for inferring fuel temperature of fuel supplied to a fuel injection valve from an engine temperature of the internal combustion engine and an intake air temperature of intake air, or from substitute information for the engine temperature and the intake air temperature; and means for correcting a shift of a fuel injection volume caused by a change in vapor generation volume, and a change in fuel density accompanying a change in fuel temperature, in accordance with the fuel temperature inferred by the inferring means;

wherein the correcting means corrects, among fuel injection times calculated as control values of the fuel injection volume, an effective injection time effectively contributing to fuel injection and an ineffective injection time not effectively contributing to the fuel injection in accordance with the inferred fuel temperature.

2. Apparatus as in claim 1, wherein the correcting means corrects a shift of the fuel injection volume so that the ineffective injection time increases as the inferred fuel temperature increases.

3. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the intake air temperature; and means for correcting, a shift of a fuel injection volume caused by a change in vapor generation volume, and a change in fuel density accompanying a change in fuel temperature, in accordance with the fuel temperature inferred by the inferring means;

wherein the correcting means corrects a shift of the fuel injection volume so that a control value of the fuel injection volume is increased as a pressure difference increases between fuel supplied to the fuel injection valve and intake manifold pressure.

4. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the intake air temperature; and means for correcting a shift of a fuel injection volume caused by a change in vapor generation volume, and a change in fuel density accompanying a change in fuel temperature, in accordance with the fuel temperature inferred by the inferring means;

wherein the inferring means factors in one of a fuel injection volume or a fuel consumption volume when inferring the fuel temperature.

5. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the intake air temperature; and means for correcting a shift of a fuel injection volume caused by a change in vapor generation volume, and a change in fuel density accompanying a change in fuel temperature, in accordance with the fuel temperature inferred by the inferring means;

wherein the inferring means infers a temperature of an indirect element transferring heat to fuel supplied to the fuel injection valve from the engine temperature and the intake air temperature, or from the substitute information for the engine temperature and the intake air temperature, and then infers the fuel temperature by factoring in at least the inferred temperature; and wherein the inferring means infers the fuel temperature by using a fuel temperature inference model set up by factoring in at least a relation between positions of fuel in a fuel supply pipe and the indirect element, as well as a fuel transfer velocity, the temperature of the indirect element, and the intake air temperature, or by factoring in the substitute information for the temperature of the indirect element and the intake air temperature.

6. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the intake air temperature; and means for correcting a shift of a fuel injection volume caused by a change in vapor generation volume, and a change in fuel density accompanying a chance in fuel temperature, in accordance with the fuel temperature inferred by the inferring means;

wherein the inferring means factors in vehicle speed when inferring the fuel temperature.

7. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the ntake air temperature; and means for correcting a shift of a fuel injection volume caused by a change in vapor generation volume, and a change in fuel density accompanying a change in fuel temperature, in accordance with the fuel temperature inferred by the inferring means; and determining means for determining a fuel property, wherein the correcting means corrects a shift of the fuel injection volume by factoring in the fuel property determined by the determining means in addition to the inferred fuel temperature.

8. Apparatus as in claim 7, wherein the determining means determines the fuel property based on a relationship between the inferred fuel temperature and the shift of a fuel injection volume.

9. Apparatus as in claim 8, further comprising:

storage means for storing an output of the determining means;

means for detecting fuel being supplied to a fuel tank; and means for resetting the output stored in the novolatile storage means.

10. Apparatus as in claim 9, further comprising means for diagnosing a fuel abnormality, wherein the determining means is disabled when the diagnosing means determines that a fuel injection abnormality exists.

11. A fuel injection control apparatus for an internal combustion engine, said apparatus comprising:

means for inferring a fuel temperature of fuel supplied to a fuel injection valve from an engine temperature of the internal combustion engine and an intake air temperature of intake air, or from substitute information for the engine temperature and the intake air temperature; and means for correcting a shift of a fuel injection volume caused by a change in vapor generation volume, and a chance in fuel density accompanying a change in fuel temperature, in accordance with the fuel temperature inferred by the inferring means;

wherein the correcting means corrects the shift of a fuel injection volume so that a control value of the fuel injection volume is increased as atmospheric pressure decreases.

12. A fuel injection control apparatus for an internal combustion engine, said apparatus comprising:

a signal input for receiving engine and intake air temperature-related information;

a controller operative to determine a fuel temperature of fuel supplied to a fuel injection valve based on the engine and intake air temperature-related information;

the controller further being operative to generate commands to correct a fuel injection volume shift caused by a change in vapor generation volume, and a change in fuel density accompanying a change in fuel temperature, in accordance with the determined fuel temperature; and a signal output that outputs the generated commands for fuel injection volume correction purposes;

wherein the engine temperature-related information is based on an indirect element that transfers heat to the fuel, and the controller determines the fuel temperature based on a fuel temperature determination model that simulates heat transfer between the indirect element and fuel located in a fuel injector supply line designated as a fuel heat propagation route.

13. Apparatus as in claim 12, wherein the fuel temperature determination model simulates heat transfer between the indirect element and the fuel located in predetermined lengths of the fuel injector supply line.

14. A fuel injection control apparatus for an internal combustion engine, said apparatus comprising:

a signal input for receiving engine and intake air temperature-related information;

a controller operative to determine a fuel temperature of fuel supplied to a fuel injection valve based on the engine and intake air temperature-related information;

the controller further being operative to generate commands to correct a fuel injection volume shift caused by a change in vapor generation volume, and a change in fuel density accompanying a chance in fuel temperature, in accordance with the determined fuel temperature; and a signal output that outputs the generated commands for fuel injection volume correction purposes;

wherein the controller-generated commands are in part based on an actual air/fuel ratio shift relative to a reference air/fuel ratio shift.

15. A fuel injection control apparatus for an internal combustion engine, said apparatus comprising:

a signal input for receiving engine and intake air temperature-related information;

a controller operative to determine a fuel temperature of fuel supplied to a fuel injection valve based on the engine and intake air temperature-related information;

the controller further being operative to generate commands to correct a fuel injection volume shift caused by a change in vapor generation volume, and a change in fuel density accompanying a change in fuel temperature, in accordance with the determined fuel temperature; and a signal output that outputs the generated commands for fuel injection volume correction purposes;

wherein the controller-generated commands are in part based on an atmospheric pressure-related variable.

16. A method for controlling a fuel injection system of an internal combustion engine, said method comprising:

receiving engine and intake air temperature-related information;

determining a fuel temperature of fuel supplied to a fuel injection valve based on the engine and intake air temperature-related information; and correcting a fuel injection volume shift caused by a chance in vapor generation volume, and a change in fuel density accompanying a chance in fuel temperature, in accordance with the determined fuel temperature;

wherein the step of determining comprises determining the fuel temperature based on a fuel temperature determination model that simulates heat transfer between the indirect element and fuel located in a fuel injector supply line designated as a fuel heat propagation route.

17. A method as in claim 16, wherein the fuel temperature determination model simulates heat transfer between the indirect element and the fuel located in predetermined lengths of the fuel injector supply line.

18. A method for controlling a fuel injection system of an internal combustion engine, said method comprising:

receiving engine and intake air temperature-related information;

determining a fuel temperature of fuel supplied to a fuel injection valve based on the engine and intake air temperature-related information; and correcting a fuel injection volume shift caused by a change in vapor generation volume, and a change in fuel density accompanying a change in fuel temperature, in accordance with the determined fuel temperature;

wherein the step of correcting includes correcting the shift of the fuel injection volume via a fuel volume correction command based on an actual air/fuel ratio shift relative to a reference air/fuel ratio shift.

19. A method for controlling a fuel injection system of an internal combustion engine, said method comprising:

receiving engine and intake air temperature-related information;

determining a fuel temperature of fuel supplied to a fuel injection valve based on the engine and intake air temperature-related information; and correcting a fuel injection volume shift caused by a chance in vapor generation volume, and a chance in fuel density accompanying a change in fuel temperature, in accordance with the determined fuel temperature;

wherein the step of correcting comprises shifting the fuel injection volume via a fuel volume correction command based on an atmospheric pressure-related variable.

* * * * *